US008377615B2

(12) United States Patent
Wu

(10) Patent No.: US 8,377,615 B2
(45) Date of Patent: Feb. 19, 2013

(54) PHOTOCONDUCTORS CONTAINING CHARGE TRANSPORTING POLYCARBONATES

(75) Inventor: Jin Wu, Pittsford, NY (US)

(73) Assignee: Xerox Corporation, Norwalk, CT (US)

( * ) Notice: Subject to any disclaimer, the term of this patent is extended or adjusted under 35 U.S.C. 154(b) by 207 days.

(21) Appl. No.: 12/952,476

(22) Filed: Nov. 23, 2010

(65) Prior Publication Data

US 2012/0129086 A1 May 24, 2012

(51) Int. Cl.
*G03G 15/02* (2006.01)

(52) U.S. Cl. ..... 430/58.75; 430/58.05; 430/58.65; 430/58.7; 430/59.1; 430/59.4

(58) Field of Classification Search ..... 430/58.05, 430/58.65, 58.7, 58.75, 59.1, 96
See application file for complete search history.

(56) References Cited

U.S. PATENT DOCUMENTS

| | | | | |
|---|---|---|---|---|
| 4,464,450 | A | 8/1984 | Teuscher | |
| 4,587,189 | A | 5/1986 | Hor et al. | |
| 4,892,811 | A | 1/1990 | Yagihara et al. | |
| 4,921,773 | A | 5/1990 | Melnyk et al. | |
| 5,030,707 | A | 7/1991 | Wang | |
| 5,409,792 | A * | 4/1995 | Yanus et al. | 430/58.6 |
| 5,482,811 | A | 1/1996 | Keoshkerian et al. | |
| 5,521,306 | A | 5/1996 | Burt et al. | |
| 5,709,974 | A * | 1/1998 | Yuh et al. | 430/123.42 |
| 6,027,848 | A * | 2/2000 | Pai et al. | 430/119.72 |
| 6,183,921 | B1 * | 2/2001 | Yu et al. | 430/58.7 |
| 6,399,264 | B1 * | 6/2002 | Ogata et al. | 430/123.51 |
| 7,005,222 | B2 | 2/2006 | Horgan et al. | |
| 7,033,714 | B2 | 4/2006 | Horgan et al. | |
| 7,618,756 | B2 * | 11/2009 | Wu et al. | 430/58.65 |
| 7,618,757 | B2 * | 11/2009 | Tong et al. | 430/58.8 |

* cited by examiner

*Primary Examiner* — Stewart Fraser
(74) *Attorney, Agent, or Firm* — Eugene O. Palazzo

(57) ABSTRACT

A photoconductor that includes a supporting substrate, a ground plane layer, a hole blocking layer, an adhesive layer, a photogenerating layer, and at least one charge transport layer of a charge transporting polycarbonate or a mixture of a charge transporting polycarbonate and a second polymer such as a polycarbonate.

20 Claims, 2 Drawing Sheets

PHOTOCONDUCTORS CONTAINING CHARGE TRANSPORTING POLYCARBONATES

There is disclosed a photoconductor comprising a supporting substrate, a photogenerating layer, and a charge transport layer that includes a charge transporting compound, a charge transporting polycarbonate, and a second polymer, such as a polycarbonate.

BACKGROUND

Photoconductors that are selected for imaging systems, such as xerographic imaging processes, are known. These photoconductors usually contain certain photogenerating layer pigments and charge transport layer components. A problem associated with a number of the known photoconductors is that undesirable image ghosting may result on the developed xerographic images, which ghosting causes image defects, and unwanted background deposits. This ghosting in turn may require the untimely replacement of photoconductors at significant costs.

Also known are photoconductors that have a minimum or lack resistance to abrasion from dust, charging rolls, toner, and carrier. While used photoconductor components can be partially recycled, there continues to be added costs and potential environmental hazards when recycling. Further, the surface layers of photoconductors are subject to scratches, which decrease their lifetime, and in xerographic imaging systems adversely affect the quality of the developed images.

Thus, there is a need for ghost resistant photoconductors with excellent or acceptable mechanical characteristics, especially in xerographic systems where biased charging rolls (BCR) are used.

There is also a need for photoconductors with acceptable low ghosting characteristics, and which photoconductors permit the rapid transport of holes in the charge transport layer present in the photoconductor, and for photoconductors with long term photoconductor stability.

Further, there is a need for new polymeric binders that can effectively have dispersed therein a charge transport compound, and which binders are compatible with conventional polymer binders used in charge transport layers, such as polycarbonates.

Photoconductors with excellent cyclic characteristics and stable electrical properties, stable long term cycling, minimal charge deficient spots (CDS), and acceptable lateral charge migration (LCM) characteristics, such as excellent LCM resistance, are also desirable.

These and other needs are believed to be achievable in embodiments with the photoconductors disclosed herein.

SUMMARY

There is disclosed a photoconductor comprising a supporting substrate, a photogenerating layer, and a charge transport layer comprising a charge transport component and a charge transporting polycarbonate polymer.

There is disclosed a photoconductor comprising a supporting substrate, a photogenerating layer, and a charge transport layer comprising a charge transport component, a charge transporting polycarbonate polymer and a polycarbonate, and wherein the ghosting characteristics of the photoconductor are from about a grade of −1 to a grade of about a −3, and the photoconductor wear rate is from about 45 nanometers per kilocycle to about 55 nanometers per kilocycle.

There is disclosed a photoconductor comprising a supporting substrate layer, a hole blocking layer, an adhesive layer, a photogenerating layer containing photogenerating pigments dispersed therein, a first charge transport layer containing a charge transport compound, and a mixture of a polycarbonate and a charge transporting polycarbonate, and a second charge transport layer containing a charge transport compound, and a mixture of a polycarbonate and a charge transporting polycarbonate, and wherein the ghosting characteristics of the photoconductor are from about a grade of −1 to a grade of about a −2.5, and the photoconductor wear rate is from about 45 nanometers per kilocycle to about 55 nanometers per kilocycle.

FIGURES

There are provided the following Figures to further illustrate the photoconductors disclosed herein.

EMBODIMENTS

In embodiments of the present disclosure, there is illustrated a photoconductor comprising in sequence a supporting substrate, an optional anticurl layer, an optional hole blocking layer, an optional adhesive layer, a photogenerating layer, and at least one charge transport layer comprising a charge transport component, a charge transporting polymer, such as a charge transporting polycarbonate copolymer and a dissimilar polycarbonate, that is a polycarbonate that is not the same as the charge transporting polymer polycarbonate illustrated herein.

Figure 1:
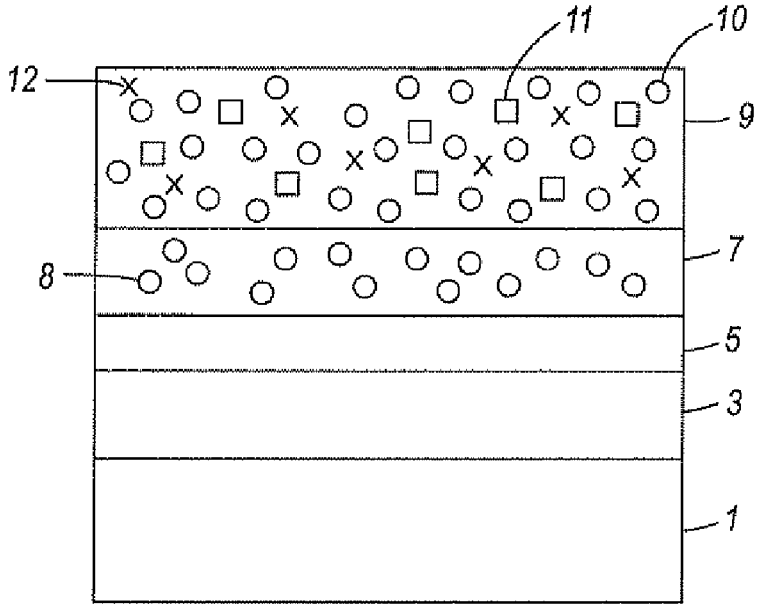
FIG. 1 illustrates an exemplary embodiment of a layered photoconductor of the present disclosure.
Figure 2:
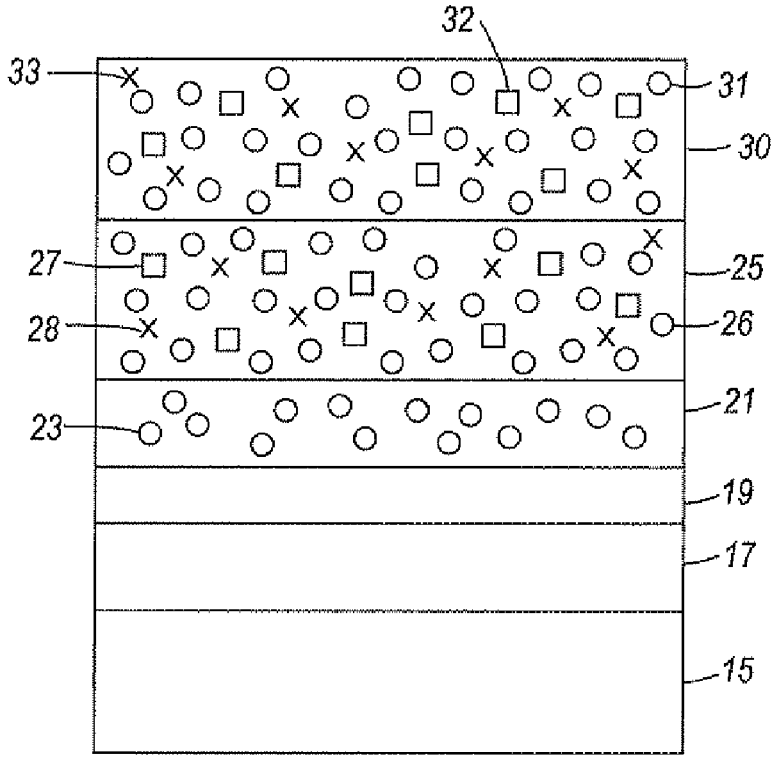
FIG. 2 illustrates another exemplary embodiment of a layered photoconductor of the present disclosure.

Exemplary and non-limiting examples of photoconductors according to embodiments of the present disclosure are depicted in FIGS. 1 and 2. In FIG. 1, there is illustrated a photoconductor comprising a supporting substrate layer 1, a hole blocking layer 3, an adhesive layer 5, a photogenerating layer 7 containing photogenerating pigments 8 dispersed therein, and a charge transport layer 9 containing charge transport compounds 10, and charge transporting polycarbonates 11 and polycarbonates 12 dispersed therein.

In FIG. 2, there is illustrated a photoconductor comprising a supporting substrate layer 15, a hole blocking layer 17, an adhesive layer 19, a photogenerating layer 21 containing photogenerating pigments 23 dispersed therein, a first charge transport layer 25 containing charge transport compounds 26, charge transporting polycarbonates 27, and polycarbonates 28 dispersed therein, and a second charge transport layer 30 containing charge transport compounds 31, charge transporting polycarbonates 32, and polycarbonates 33 dispersed therein.

Figure 3:
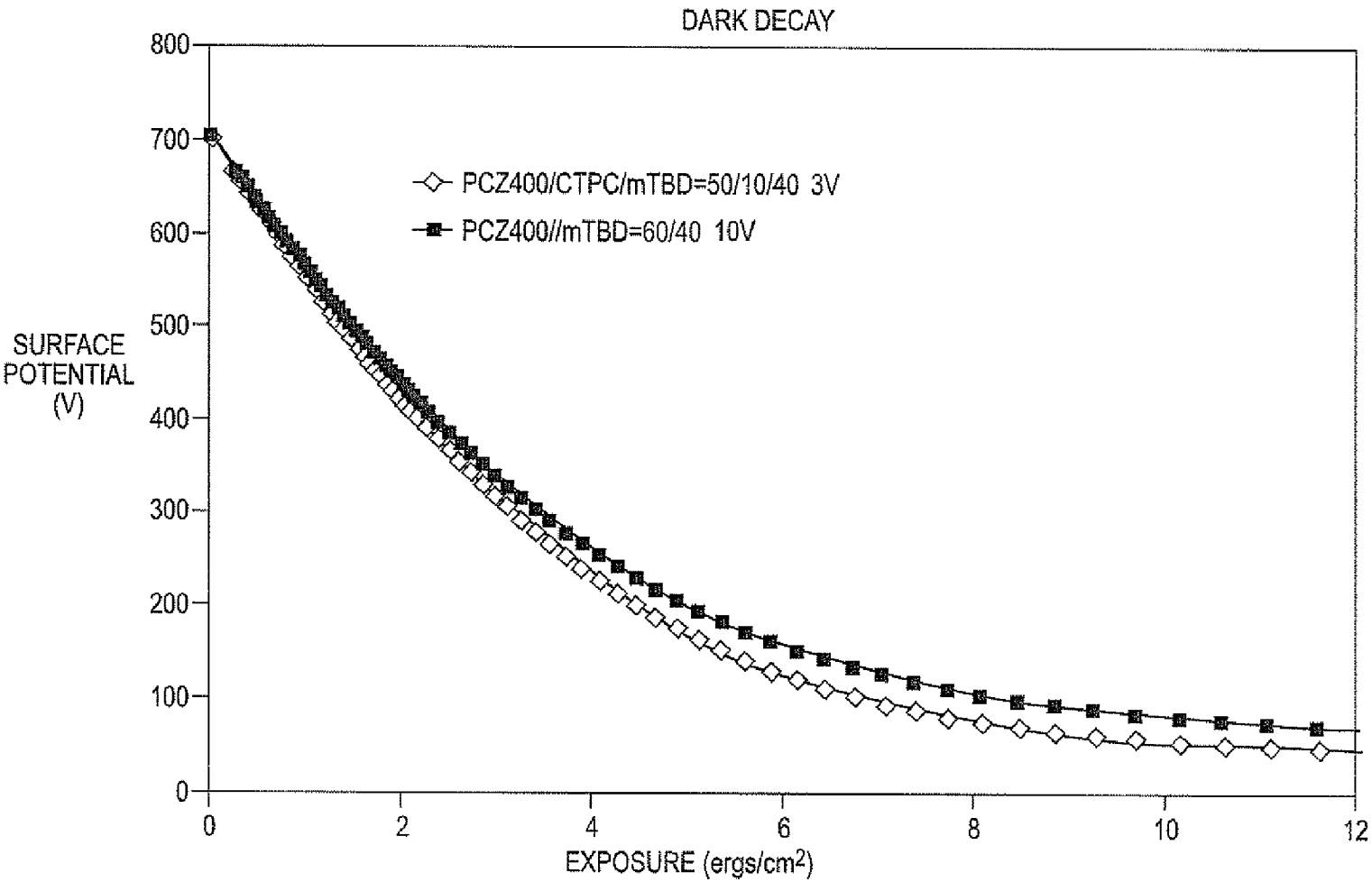
FIG. 3 illustrates a graph of the surface potential (in Volts) versus exposure (in ergs/cm$^2$).

In FIG. 3, there is illustrated a graph of the PIDC comparison between the photoconductor of Comparative Example 1 versus the photoconductor PIDC of the Example I photoconductor of the present disclosure. The graph illustrates the surface potential in volts from 0 to 800 versus the exposure in ergs/cm$^2$, from 0 to 12. The dark decay of the Example I photoconductor is 3V (volts), and the dark decay of the Comparative Example 1 photoconductor is 10V (volts). This FIG. 3 graph illustrates that the disclosed photoconductor of Example III exhibited a more rapid transport of the charge transport compounds versus the Comparative Example 1 photoconductor.

Substrate

The substrate may comprise a layer of an electrically nonconductive or conductive material such as electrically nonconducting materials. Examples include polyesters, polycarbonates, polyamides, polyurethanes, and the like, and mixtures thereof.

An electrically conducting supporting substrate may be any suitable metal including aluminum, nickel, steel, copper, gold, and the like, and mixtures thereof, or a polymeric material filled with an electrically conducting substance. Examples of electrically conducting substances include carbon, metallic powder, and the like, or an organic electrically conducting material. The electrically insulating or conductive substrate may be in the form of an endless flexible belt, a web, a rigid cylinder, a sheet, a drelt (a cross between a drum and a belt), and the like.

In embodiments where the substrate layer is not conductive, the surface may be rendered electrically conductive by depositing thereon a known electrically conductive coating. The conductive coating may vary in thickness over substantially wide ranges, such as from about 1 to about 50 microns, from 1 to about 35 microns, or from about 3 to about 25 microns, depending upon the optical transparency, degree of flexibility desired, and economic factors.

The thickness of the photoconductor supporting substrate depends on many factors, including economical considerations, electrical characteristics, adequate flexibility, availability and cost of the specific components for each layer, and the like. Thus, this layer may be of a substantial thickness, for example up to about 3,000 microns, such as from about 1,000 to about 2,000 microns, from about 500 to about 1,000 microns, or from about 300 to about 700 microns, or of a minimum thickness. In embodiments, the thickness of this layer is from about 75 to about 300 microns, or from about 100 to about 150 microns.

Illustrative examples of substrates include a layer of insulating material including inorganic or organic polymeric materials, such as MYLAR® (a commercially available polymer), MYLAR® containing titanium, a layer of an organic or inorganic material having a semiconductive surface layer such as indium tin oxide or aluminum arranged thereon, or a conductive material inclusive of aluminum, chromium, nickel, brass, or the like, and mixtures thereof. The substrate may be flexible, seamless, or rigid, and may have a number of many different configurations, such as for example, a plate, a cylindrical drum, a scroll, an endless flexible belt, a drelt, and the like. In embodiments, the substrate is in the form of a seamless flexible belt.

Anticurl Layer

In some situations, it may be desirable to coat an anticurl layer on the back of the substrate, particularly when the substrate is a flexible organic polymeric material. This anticurl layer is sometimes referred to as an anticurl backing layer. Suitable materials for an anticurl layer include, for example, polycarbonate materials commercially available as MAKROLON®, and the like. The anticurl layer can be of a thickness of from about 0.1 to about 5 microns, from about 0.5 to about 3 microns, or from about 1 to about 2 microns.

Ground Plane Layer

Positioned on the top side of the supporting substrate can be included a ground plane such as gold, gold containing compounds, aluminum, titanium, titanium/zirconium, and other suitable known components. The thickness of the ground plane layer can be from about 10 to about 100 nanometers, from about 20 to about 50 nanometers, or about 35 nanometers. The titanium or titanium/zirconium ground plane can have a thickness of from about 10 to about 30 nanometers, or about 20 nanometers Hole-Blocking Layer A charge blocking layer or hole blocking layer may optionally be applied to the electrically conductive supporting substrate surface prior to the application of a photogenerating layer. An optional charge blocking layer or hole blocking layer, when present, is usually in contact with the ground plane layer, and also can be in contact with the supporting substrate. The hole blocking layer generally comprises any of a number of known components as illustrated herein, such as metal oxides, phenolic resins, aminosilanes, and the like, and mixtures thereof. The hole-blocking layer can have a thickness of from about 0.01 to about 30 microns, from about 0.02 to about 5 microns, or from about 0.03 to about 0.5 micron.

Examples of aminosilanes that can be included in the hole blocking layer can be represented by

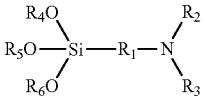

wherein $R_1$ is a straight chain or branched alkylene group containing from 1 to about 25, from 1 to about 18, from 1 to about 12, or from 1 to about 6 carbon atoms; $R_2$ and $R_3$ are independently selected from the group consisting of at least one of hydrogen, alkyl containing from 1 to about 12 carbon atoms, or from 1 to about 4 carbon atoms, aryl with from about from about 6 to about 24, from about 6 to about 18, or from about 6 to about 12 carbon atoms, such as a phenyl group; and a poly(alkylene amino) group, such as a poly (ethylene amino) group, where $R_4$, $R_5$ and $R_6$ are independently an alkyl group containing from 1 to about 10 carbon atoms or from 1 to about 4 carbon atoms.

Specific examples of suitable aminosilanes include 3-aminopropyl triethoxysilane, N,N-dimethyl-3-aminopropyl triethoxysilane, N-phenylaminopropyl trimethoxysilane, triethoxysilylpropylethylene diamine, trimethoxysilylpropylethylene diamine, trirnethoxysilylpropyldiethylene triamine, N-aminoethyl-3-aminopropyl trimethoxysilane, N-2-aminoethyl-3-aminopropyl trimethoxysilane, N-2-aminoethyl-3-aminopropyl tris(ethylethoxy) silane, p-aminophenyl trimethoxysilane, N,N'-dimethyl-3-aminopropyl triethoxysilane, 3-aminopropylmethyl diethoxysilane, 3-aminopropyl trimethoxysilane, N-methylaminopropyl triethoxysilane, methyl[2-(3-trimethoxysilylpropylamino)ethylamino]-3-proprionate, (N,N'-dimethyl 3-amino)propyl triethoxysilane, N,N-dimethylaminophenyl triethoxysilane, trimethoxysilyl propyldiethylene triamine, and the like, and mixtures thereof. Yet more specific aminosilane materials are 3-aminopropyl triethoxysilane (γ-APS), N-aminoethyl-3-aminopropyl trimethoxysilane, (N,N'-dimethyl-3-amino)propyl triethoxysilane, and mixtures thereof.

The aminosilane may be hydrolyzed to form a hydrolyzed silane solution before being added into the final hole blocking layer coating solution or dispersion. During hydrolysis of the aminosilanes, the hydrolyzable groups, such as the alkoxy groups, are replaced with hydroxyl groups. The pH of the hydrolyzed silane solution can be controlled to obtain excellent characteristics on curing, and to result in electrical stability. A solution pH of, for example, from about 4 to about 10 can be selected, such as a pH of from about 7 to about 8.

Control of the pH of the hydrolyzed silane solution may be affected with any suitable material, such as generally organic acids or inorganic acids. Typical organic and inorganic acids include acetic acid, citric acid, formic acid, hydrogen iodide, phosphoric acid, hydrofluorosilicic acid, p-toluene sulfonic acid, and the like.

The hole blocking layer can, in embodiments, be prepared by a number of known methods, the process parameters being dependent, for example, on the photoconductor member desired. The hole blocking layer can be coated as a solution or a dispersion onto the supporting substrate, or on to the ground plane layer by the use of a spray coater, dip coater, extrusion coater, roller coater, wire-bar coater, slot coater, doctor blade coater, gravure coater, and the like, and dried at from about 40° C. to about 200° C. or from 75° C. to 150° C. for a suitable period of time, such as from about 1 minute to about 10 hours, from about 40 minutes to about 100 minutes, or from about 1 hour to about 4 hours in the presence of an air flow. The coating can be accomplished in a manner to provide a final hole blocking layer coating thickness of, for example, from about 0.01 to about 30 microns, from about 0.02 to about 5 microns, or from about 0.03 to about 0.5 micron after drying.

Adhesive Layer

An adhesive layer may be included between the hole blocking layer and the photogenerating layer. Typical adhesive layer materials include polyesters, polyurethanes, copolyesters, polyamides, poly(vinyl butyrals), poly(vinyl alcohols), polyacrylonitriles, and the like, and mixtures thereof. The adhesive layer thickness can be from about 0.001 to about 1 micron, from about 0.05 to about 0.5 micron, or from about 0.1 to about 0.3 micron. Optionally, this layer may contain effective suitable amounts of from about 1 to about 10, or from 1 to about 5 weight percent, of conductive and nonconductive particles, such as zinc oxide, titanium dioxide, silicon nitride, carbon black, and the like, and mixtures thereof.

Photogenerating Layer

Usually, the photogenerating layer is applied onto the supporting substrate, and a charge transport layer or plurality of charge transport layers is formed on the photogenerating layer. The charge transport layer may be situated on the photogenerating layer, the photogenerating layer may be situated on the charge transport layer, or when more than one charge transport layer is present, they can be contained on the photogenerating layer. Also, the photogenerating layer may be applied to the layers situated between the supporting substrate and the photogenerating layer.

Generally, the photogenerating layer can contain known photogenerating pigments, such as metal phthalocyanines, metal free phthalocyanines, alkylhydroxyl gallium phthalocyanines, hydroxygallium phthalocyanines, chlorogallium phthalocyanines, perylenes, such as bis(benzimidazo) perylene, titanyl phthalocyanines, and the like, and mixtures thereof. More specific examples include vanadyl phthalocyanines, Type V hydroxygallium phthalocyanines, high sensitivity titanyl phthalocyanines, and inorganic components such as selenium, selenium alloys, and trigonal selenium; pigments of crystalline selenium and its alloys; and Groups II to VI compounds. Organic pigment examples are quinacridones, polycyclic pigments such as dibromo anthanthrone pigments, perinone diamines, polynuclear aromatic quinones, azo pigments including bis-, tris- and tetrakis-azos, and the like.

The photogenerating pigment can be dispersed in a resin binder similar to the resin binders selected for the charge transport layer, or alternatively no resin binder need be present. For example, the photogenerating pigment can be present in an optional resinous binder composition in various amounts inclusive of up to 100 percent by weight. Generally, from about 5 to about 95 percent by volume of the photogenerating pigment is dispersed in about 95 to about 5 percent by volume of a resinous binder, or from about 20 to about 30 percent by volume of the photogenerating pigment is dispersed in about 70 to about 80 percent by volume of the resinous binder composition. In one embodiment, about 90 percent by volume of the photogenerating pigment is dispersed in about 10 percent by volume of the resinous binder composition, and which resin may be selected from a number of known polymers as illustrated herein, such as poly(vinyl butyral), poly(vinyl carbazole), polyesters, polycarbonates, poly(vinyl chloride), polyacrylates and methacrylates, copolymers of vinyl chloride and vinyl acetate, phenolic resins, polyurethanes, poly(vinyl alcohol), polyacrylonitrile, polystyrene, and the like.

It is often desirable to select a coating solvent for the photogenerating layer mixture, and which solvent does not substantially disturb or adversely affect the previously coated layers of the photoconductor. Examples of coating solvents used for the photogenerating layer coating mixture include ketones, alcohols, aromatic hydrocarbons, halogenated aliphatic hydrocarbons, ethers, amines, amides, esters, and the like, and mixtures thereof. Specific solvent examples are cyclohexanone, acetone, methyl ethyl ketone, methanol, ethanol, butanol, amyl alcohol, toluene, xylene, chlorobenzene, carbon tetrachloride, chloroform, methylene chloride, trichloroethylene, tetrahydrofuran, dioxane, diethyl ether, dimethyl formamide, dimethyl acetamide, butyl acetate, ethyl acetate, methoxyethyl acetate, and the like.

Examples of polymeric binder materials that can be selected as the matrix for the photogenerating layer include thermoplastic and thermosetting resins, such as polycarbonates, polyesters, polyamides, polyurethanes, polystyrenes, polyarylethers, polyarylsulfones, polybutadienes, polysulfones, polyethersulfones, polyethylenes, polypropylenes, polyimides, polymethylpentenes, poly(phenylene sulfides), poly(vinyl acetate), polysiloxanes, polyacrylates, polyvinyl acetals, polyamides, polyimides, amino resins, phenylene oxide resins, terephthalic acid resins, phenoxy resins, epoxy resins, phenolic resins, polystyrene, acrylonitrile copolymers, poly(vinyl chloride), vinyl chloride and vinyl acetate copolymers, acrylate copolymers, alkyd resins, cellulosic film formers, poly(amideimide), styrene butadiene copolymers, vinylidene chloride-vinyl chloride copolymers, vinyl acetate-vinylidene chloride copolymers, styrene-alkyd resins, polyvinyl carbazole), and the like. These polymers may be block, random, or alternating copolymers.

The photogenerating layer can be of a thickness of from about 0.01 to about 10 microns, from about 0.05 to about 10 microns, from about 0.2 to about 2 microns, or from about 0.25 to about 2 microns.

Charge Transport Layer

The charge transport layer generally comprises a charge transporting compound, a charge transporting polycarbonate, and optionally a second polymer, such as a polycarbonate.

The disclosed photoconductor charge transport layer comprises a charge transporting polycarbonate selected from the group consisting of the following formulas/structures

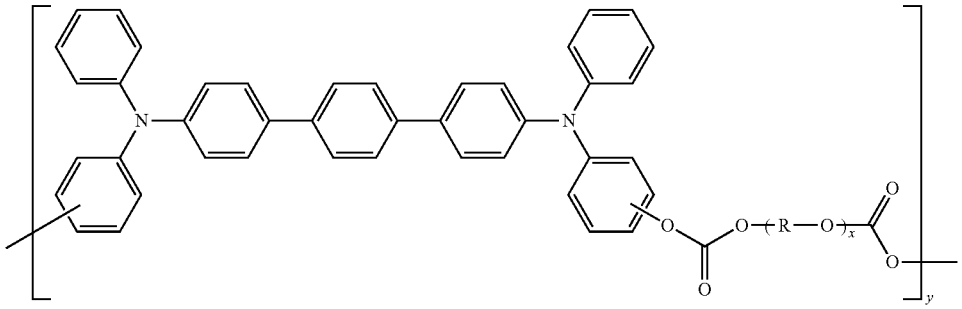

and

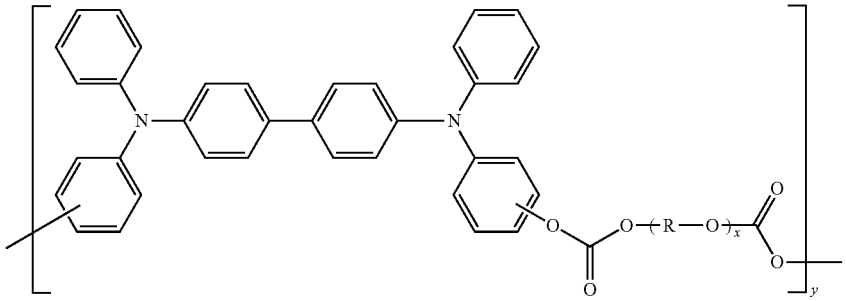

where R is a straight chain or branched alkylene with, for example, from 1 to about 18 carbon atoms, from 2 to about 15 carbon atoms, from 2 to about 10 carbon atoms, or from 2 to about 5 carbon atoms, like methylene, ethylene, propylene, butylene, pentaylene, and the like; x represents the number of groups of from about 1 to about 20, from about 1 to about 15, from about 1 to about 10, from 1 to about 6, or from about 2 to about 7; and y represents the number of repeating segments in the charge transporting polycarbonate, and is a number of from about 10 to about 5,000, from about 50 to about 4,000, from about 100 to about 3,500, from about 200 to about 3,000, or from about 500 to about 2,000, and mixtures thereof.

Examples of specific charge transporting polycarbonate polymers that can be present in the charge transport layer include those polymers represented by the following formulas/structures

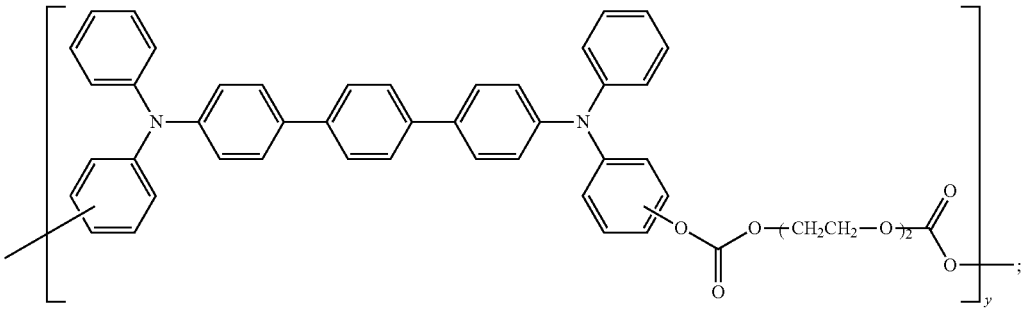

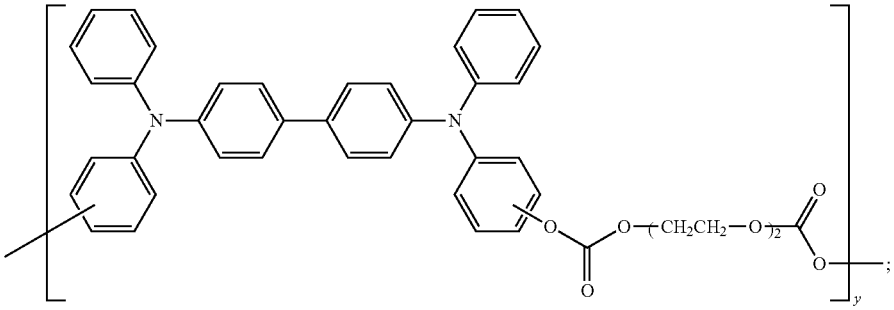

-continued
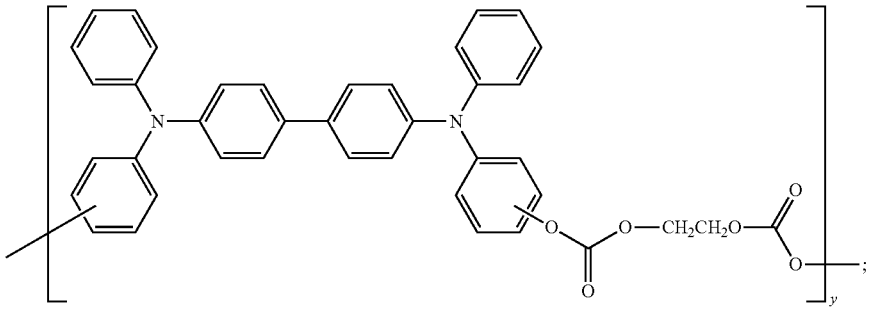
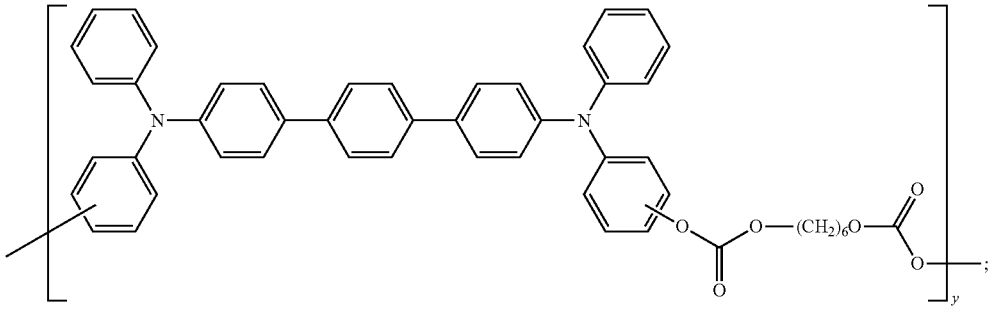
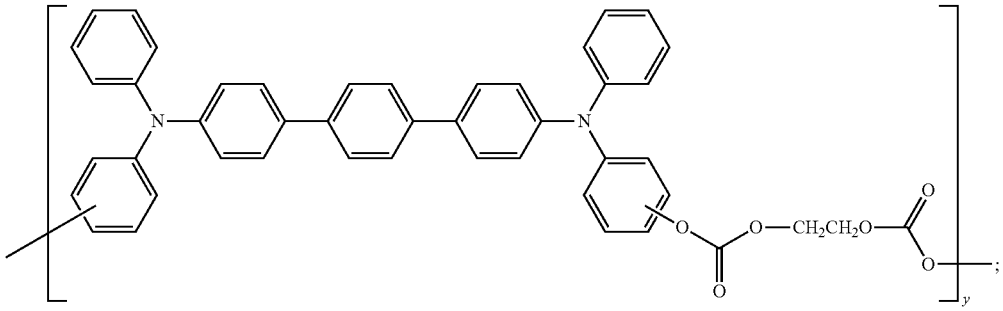
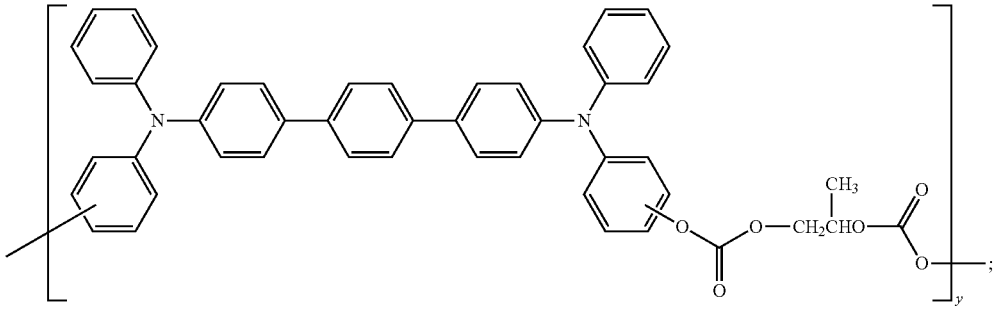
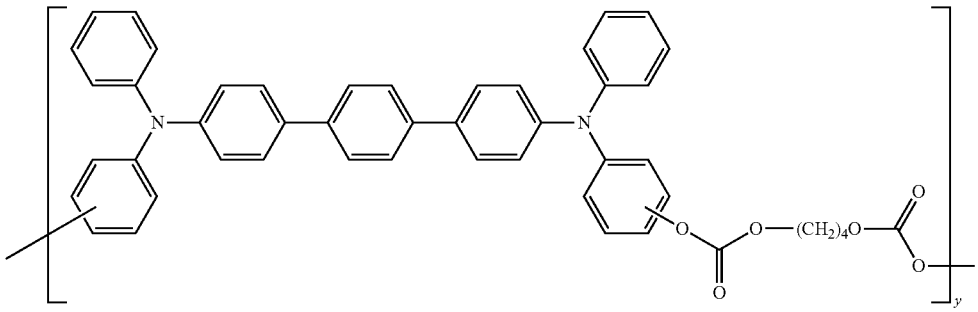
and

-continued

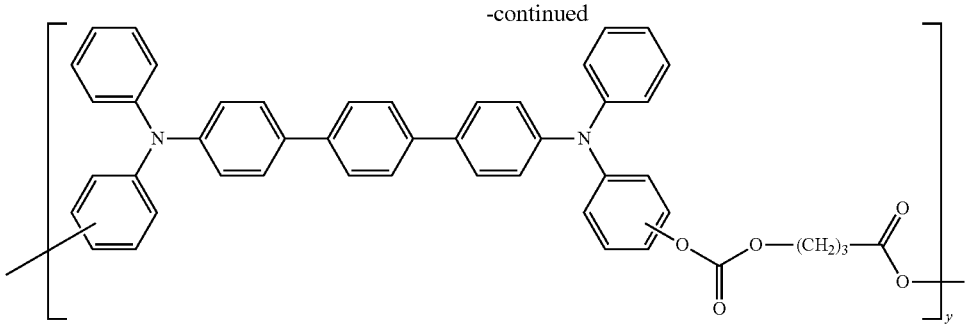

where y is as defined above.

The weight average molecular weight ($M_w$) of the charge transporting polycarbonates can be, for example, from about 10,000 to about 500,000, from about 25,000 to about 400,000, or from about 100,000 to about 300,000, and the number average molecular weight ($M_n$) of the charge transporting polycarbonates can be, for example, from about 5,000 to about 350,000, from about 20,000 to about 200,000, or from about 50,000 to about 150,000. The weight average and number average molecular weights of the charge transporting polycarbonate can be determined by Gel Permeation Chromatography (GPC).

The weight percent of the charge transporting polycarbonate present in the charge transport layer can be, for example, from about 1 to about 60 weight percent, from about 5 to about 40 weight percent, or from about 10 to about 30 weight percent based on the total solids content of the charge transport layer.

The charge transporting polycarbonate polymers can be prepared by any suitable method known in the art. For example, the charge transporting polycarbonate polymers can be prepared from a hydroxy arylamine, such as those represented by the following formulas/structures

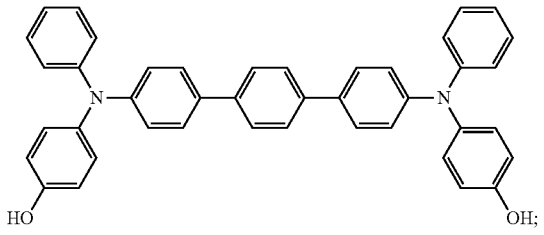

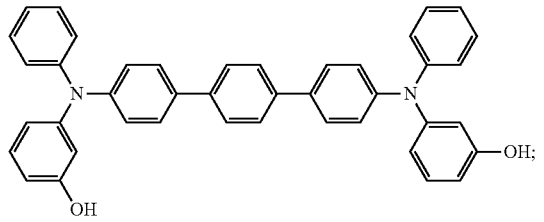

-continued

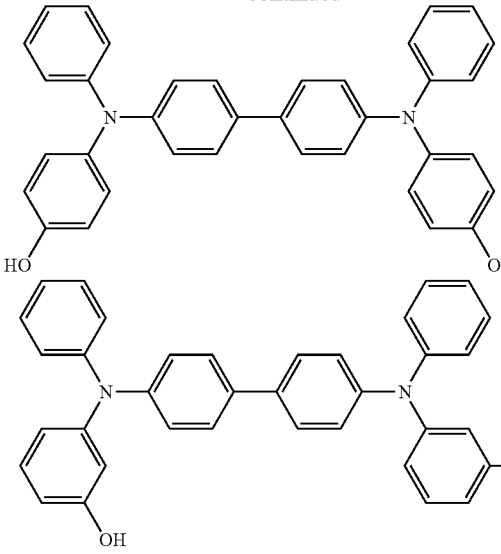

The hydroxyaryl amine can be mixed and reacted by heating at a temperature of from about −20° C. to about 70° C., or from about 10° C. to about 50° C. with a trialkylamine catalyst, like a triethylamine, a trimethylamine or a tripropylamine, followed by the addition to the resulting mixture of a bishaloformate such as an ethylene glycol bischloroformate, a diethylene glycol bischloroformate, a triethylene glycol bischloroformate, a propylene glycol bischloroformate, a 1,6-hexanediol bischloroformate, a 1,4-butanediol bischloroformate, or a 1,3-propanediol bischloroformate. There is formed, almost immediately, a colorless precipitate of a trialkylamine hydrochloride. To the precipitate can then be added a phenol dispersed in a solvent like tetrahydrofuran, or methylene chloride. The mixture resulting is stirred and the solution obtained can be filtered to remove any trialkylamine hydrochloride. The resultant polymer solution is then precipitated into an alcohol like methanol, filtered and dried to form the charge transporting polycarbonate illustrated herein as identified by NMR analysis.

The photoconductor charge transport layer or layers can include a second optional polymer like a polycarbonate, which polycarbonate is different, where different refers to a dissimilar than or not the same as the charge transporting polycarbonate. The polycarbonate can be, for example, prepared from di(hydroxyphenyl)alkanes, such as 2,2-di(4-hydroxyphenyl)propane, as illustrated in U.S. Pat. No. 5,030, 707, the disclosure of which is totally incorporated herein by reference. Examples of polycarbonates are PCZ-400 [poly(4,4'-dihydroxy-diphenyl-1-1-cyclohexane, $M_w$=40,000)], available from Mitsubishi Gas Chemical Company, Ltd.; poly (4,4'-isopropylidene-diphenylene) carbonate (also referred to as bisphenol-A-polycarbonate), poly(4,4'-cyclohexylidine diphenylene) carbonate (also referred to as bisphenol-Z-polycarbonate), poly(4,4'-isopropylidene-3,3'-dimethyl-diphenyl) carbonate (also referred to as bisphenol-C-polycarbonate), and the like, and mixtures thereof, and other known suitable polycarbonates.

The polycarbonate number average molecular weight ($M_n$) is, for example, from about 10,000 to about 80,000, or from about 20,000 to about 60,000, and the weight average molecular weight ($M_w$) of the polycarbonate is, for example, from about 20,000 to about 100,000, or from about 40,000 to about 80,000, where $M_w$ and $M_n$ can be determined by Gel Permeation Chromatography (GPC).

When mixtures of the charge transporting polycarbonate polymer and a second polymer binder are selected, such as the polycarbonates disclosed herein, the amount of the charge transporting polycarbonate (CTPC) present in the charge transport layer is, for example, from 1 to about 99 weight percent, from 3 to about 50 weight percent, or from about 5 to about 30 weight percent, and the amount of the second polymer present in the charge transport layer is from 99 to about 1 weight percent, from about 97 to about 50 weight percent, or from about 95 to about 30 weight percent, and where the total of the charge transporting polycarbonate and the second polymer is about 100 weight percent.

Examples of charge transport components included in the charge transport layer are selected from the group consisting of those represented by the following formulas/structures

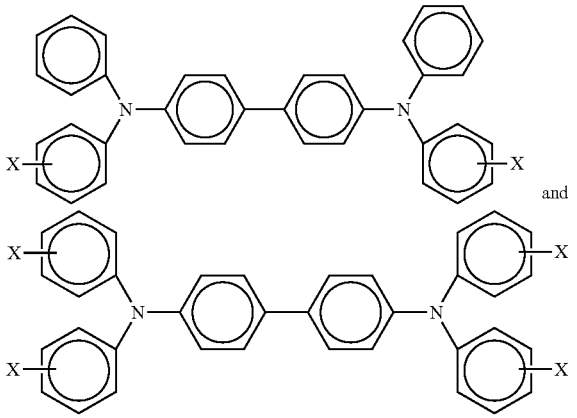

and wherein X is alkyl, such as $CH_3$, alkoxy, aryl, and derivatives thereof; a halogen, such as Cl; or mixtures thereof; and molecules of the following formulas

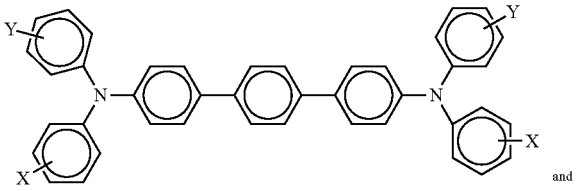

and

-continued

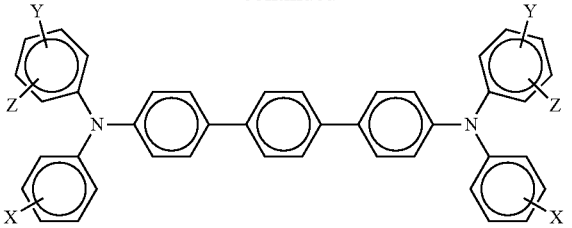

wherein X, Y and Z are independently alkyl, alkoxy, aryl, a halogen, or mixtures thereof.

The alkyl and alkoxy groups for the above charge transport compounds contain from 1 to about 25 carbon atoms, such as from 1 to about 12 carbon atoms, such as methyl, ethyl, propyl, butyl, pentyl, and the corresponding alkoxides. Aryl can contain from about 6 to about 36 carbon atoms, from about 6 to about 24, from about 6 to about 18, or from about 6 to about 12 carbon atoms, such as phenyl, napthyl, and anthryl, and the like. Halogen includes chloride or chlorine, bromide or bromine, iodide or iodine, and fluoride or fluorine.

Examples of specific aryl amines that can be selected for the charge transport layer include N,N-diphenyl-N,N-bis(alkylphenyl)-1,1-biphenyl-4,4'-diamine wherein alkyl is selected from the group consisting of methyl, ethyl, propyl, butyl, hexyl, and the like; N,N'-diphenyl-N,N'-bis(halophenyl)-1,1'-biphenyl-4,4'-diamine wherein the halo substituent is a chloro substituent, N,N'-bis(4-butylphenyl)-N,N'-di-p-tolyl-[p-terphenyl]-4,4"-diamine, N,N'-bis(4-butylphenyl)-N,N'-di-m-tolyl-[p-terphenyl]-4,4"-diamine, N,N'-bis(4-butylphenyl)-N,N'-di-o-tolyl-[p-terphenyl]-4,4"-diamine, N,N'-bis(4-butylphenyl)-N,N'-bis-(4-isopropylphenyl)-[p-terphenyl]-4,4"-diamine, N,N'-bis(4-butylphenyl)-N,N-bis-(2-ethyl-6-methylphenyl)-[p-terphenyl]-4,4"-diamine, N,N'-bis(4-butylphenyl)-N,N'-bis-(2,5-dimethylphenyl)-[p-terphenyl]-4,4'-diamine, N,N'-diphenyl-N,N'-bis(3-chlorophenyl)-[p-terphenyl]-4,4"-diamine, and the like. Other known charge transport layer molecules that can be selected are described in U.S. Pat. Nos. 4,921,773 and 4,464,450, the disclosures of which are totally incorporated herein by reference.

A small molecule charge transporting compound that permits injection of holes into the photogenerating layer with high efficiency, and transports them across the charge transport layer with short transit times includes N,N'-diphenyl-N,N'-bis(3-methylphenyl)-(1,1'-biphenyl)-4,4'-diamine, N,N'-bis(4-butylphenyl)-N,N'-di-p-tolyl-[p-terphenyl]-4,4"-diamine, N,N'-bis(4-butylphenyl)-N,N'-di-m-tolyl-[p-terphenyl]-4,4"-diamine, N,N'-bis(4-butylphenyl)-N,N'-di-o-tolyl-[p-terphenyl]-4,4"-diamine, N,N'-bis(4-butylphenyl)-N,N'-bis-(4-isopropylphenyl)-[p-terphenyl]-4,4"-diamine, N,N'-bis(4-butylphenyl)-N,N'-bis-(2-ethyl-6-methylphenyl)-[p-terphenyl]-4,4"-diamine, N,N'-bis(4-butylphenyl)-N,N'-bis-(2,5-dimethylphenyl)-[p-terphenyl]-4,4"-diamine, and N,N'-diphenyl-N,N'-bis(3-chlorophenyl)-[p-terphenyl]-4,4"-diamine, or mixtures thereof. When desired, the charge transport material in the charge transport layer may comprise a polymeric charge transport material, or a combination of a small molecule charge transport material and a polymeric charge transport material.

A number of processes may be used to mix, and thereafter apply the charge transport layer or layers coating mixture to the photogenerating layer. Typical application techniques include spraying, dip coating, roll coating, wire wound rod coating, and the like. Drying of the charge transport deposited coating may be effected by any suitable conventional technique such as oven drying, infrared radiation drying, air drying, and the like.

The charge transport layer can be from about 5 to about 75 microns, or from about 10 to about 40 microns in thickness.

Examples of components or materials optionally incorporated into the charge transport layers, or at least one charge transport layer to enable excellent lateral charge migration (LCM) resistance include hindered phenolic antioxidants, such as tetrakis methylene(3,5-di-tert-butyl-4-hydroxy hydrocinnamate) methane (IRGANOX™ 1010, available from Ciba Specialty Chemical), butylated hydroxytoluene (BHT), and other hindered phenolic antioxidants including SUMILIZER™ BHT-R, MDP-S, BBM-S, WX-R, NR, BP-76, BP-101, GA-80, GM and GS (available from Sumitomo Chemical Co., Ltd.), IRGANO™ 1035, 1076, 1098, 1135, 1141, 1222, 1330, 1425WL, 1520L, 245, 259, 3114, 3790, 5057 and 565 (available from Ciba Specialties Chemicals), and ADEKA STA™ AO-20, AO-30, AO-40, AO-50, AO-60, AO-70, AO-80 and AO-330 (available from Asahi Denka Co., Ltd.); hindered amine antioxidants such as SANOL™ LS-2626, LS-765, LS-770 and LS-744 (available from SNKYO CO., Ltd.), TINUVIN™ 144 and 622LD (available from Ciba Specialties Chemicals), MARK™ LA57, LA67, LA62, LA68 and LA63 (available from Asahi Denka Co., Ltd.), and SUMILIZER™ TPS (available from Sumitomo Chemical Co., Ltd.); thioether antioxidants such as SUMILIZER™ TP-D (available from Sumitomo Chemical Co., Ltd); phosphite antioxidants such as MARK™ 2112, PEP-8, PEP-24G, PEP-36, 329K and HP-10 (available from Asahi Denka Co., Ltd.); other molecules such as bis(4-diethylamino-2-methylphenyl)phenylmethane (BDETPM), bis-[2-methyl-4-(N-2-hydroxyethyl-N-ethyl-aminophenyl)]-phenylmethane (DHTPM), and the like. The weight percent of the antioxidant in at least one of the charge transport layers is from about 0 to about 20 weight percent, from about 1 to about 10 weight percent, or from about 3 to about 8 weight percent.

In embodiments, the ghosting characteristics of the photoconductors of the present disclosure as determined by grades as illustrated herein are excellent of from about a −1 to about a −3.5, from about a −1 to about a −3, from about a −1 to about a −2.5, from about a −2 to about a −3.5, from about a −2 to about a −3 or from about a −2.5 to about a −3, and where the photoconductors have a wear rate of from about 40 nanometers per xerographic kilocycle to about 55 nanometers per xerographic kilocycle, from about 45 nanometers per xerographic kilocycle to about 55 nanometers per xerographic kilocycle or about 50 nanometers per xerographic kilocycle. In embodiments, the photoconductors disclosed herein have a ghosting value of from about a −2 grade to about a −3 grade, and a wear rate of from about 45 to about 55 nanometers per xerographic kilocycle.

Also included within the scope of the present disclosure are methods of imaging and printing with the photoconductors illustrated herein. These methods generally involve the formation of an electrostatic latent image on the imaging member, followed by developing the image with a toner composition comprised, for example, of thermoplastic resin, colorant, such as pigment, charge additive, and surface additive, subsequently transferring the toner image to a suitable image receiving substrate, and permanently affixing the image thereto. In those environments wherein the photoconductor is to be used in a printing mode, the imaging method involves the same operation with the exception that exposure can be accomplished with a laser device or image bar. More specifically, the flexible photoconductors disclosed herein can be selected for the Xerox Corporation iGENI® machines that generate with some versions over 100 copies per minute. Processes of imaging, especially xerographic imaging and printing, including digital and/or color printing are thus encompassed by the present disclosure. The imaging members are, in embodiments, sensitive in the wavelength region of, for example, from about 400 to about 900 nanometers, and in particular from about 650 to about 850 nanometers, thus diode lasers can be selected as the light source. Moreover, the imaging members of this disclosure are useful in color xerographic applications, particularly high-speed color copying and printing processes inclusive of digital xerographic processes.

The following Examples are being submitted to illustrate embodiments of the present disclosure. Products and structures were confirmed by NMR analysis.

Example I

Preparation of Charge Transporting Polycarbonate

26 Grams of N,N'-diphenyl N,N' bis(3-hydroxyphenyl)-{1,1'biphenyl}-4,4'-diamine (DHTBD), 200 milliliters of dry tetrahydrofuran, and 21 milliliters of triethylamine were placed into a 500 milliliter three-necked round bottom flask equipped with a mechanical stirrer, an argon gas inlet and a dropping funnel. 8.4 Milliliters of diethylene glycol bischloroformate in 40 milliliters of dry tetrahydrofuran were added dropwise into the flask. A colorless precipitate of triethylamine hydrochloride was formed almost immediately. After 30 minutes, the addition of the diethylene glycol bischloroformate was completed, and the resulting viscous mixture was allowed to stir for 15 minutes. Approximately 0.2 gram of phenol in 10 milliliters of dry tetrahydrofuran was then added to the formed polymer mixture, and this mixture was allowed to stir for 5 minutes. The polymer solution resulting was then filtered to remove the triethylamine hydrochloride. The colorless polymer solution was precipitated into methanol, filtered, and dried. The product resulting had the following structure.

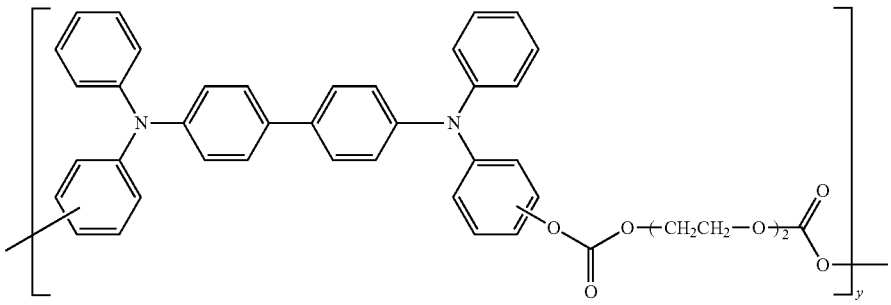

as determined by NMR analysis, with a weight average molecular weight ($M_w$) of 100,000, and a number average molecular weight ($M_n$) of 50,000 and where y is 450.

Example II

Preparation of Charge Transporting Polycarbonate

26 Grams of N,N'-diphenyl N,N' bis(3-hydroxyphenyl)-{1,1'terphenyl}-4,4'-diamine (DHTER), 200 milliliters dry tetrahydrofuran, and 21 milliliters triethylamine are placed into a 500 milliliter three-necked round bottom flask equipped with a mechanical stirrer, an argon gas inlet, and a dropping funnel. 8.4 Milliliters of diethylene glycol bischloroformate in 40 milliliters of dry tetrahydrofuran is added dropwise into the flask. A colorless precipitate of triethylamine hydrochloride is formed almost immediately. After 30 minutes, the addition of the diethylene glycol bischloroformate is complete, and the resulting viscous mixture is allowed to stir for 15 minutes. Approximately 0.2 gram of phenol in 10 milliliters of dry tetrahydrofuran is added to the formed polymer mixture, and the mixture is allowed to stir for 5 minutes. The polymer solution resulting is then filtered to remove the triethylamine hydrochloride. The colorless polymer solution is precipitated into methanol, filtered, and dried. The product resulting is of the following structure

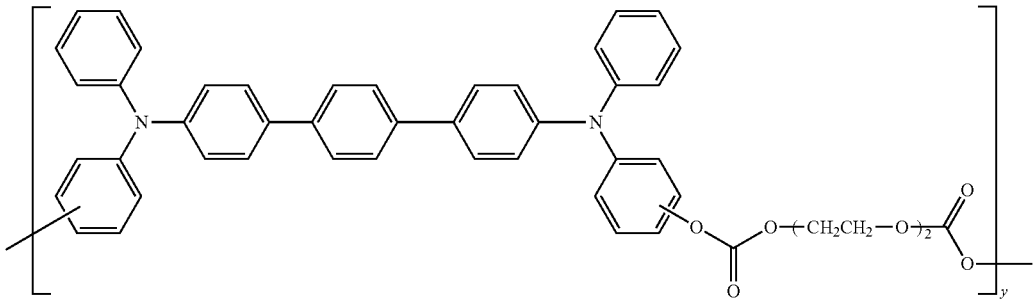

where y is 450.

Comparative Example 1

On a 30 millimeter thick aluminum drum substrate, an undercoat layer was prepared, and deposited thereon as follows.

Zirconium acetylacetonate tributoxide (35.5 parts), γ-aminopropyl triethoxysilane (4.8 parts), and poly(vinyl butyral) BM-S (2.5 parts) were dissolved in n-butanol (52.2 parts). The resulting solution was then coated by a dip coater on the above aluminum drum substrate, and the coating solution layer was preheated at 59° C. for 13 minutes, humidified at 58° C. (dew point=54° C.) for 17 minutes, and dried at 135° C. for 8 minutes. The thickness of the resulting undercoat layer was approximately 1.3 microns.

A photogenerating layer, 0.2 micron in thickness, comprising chlorogallium phthalocyanine (Type C) was deposited on the above undercoat layer. The photogenerating layer coating dispersion was prepared as follows. 2.7 Grams of chlorogallium phthalocyanine (ClGaPc) Type C pigment were mixed with 2.3 grams of the polymeric binder (carboxyl-modified vinyl copolymer, VMCH, available from Dow Chemical Company), 15 grams of n-butyl acetate, and 30 grams of xylene. The resulting mixture was mixed in an Attritor mill with about 200 grams of 1 millimeter Hi-Bea borosilicate glass beads for about 3 hours. The dispersion mixture obtained was then filtered through a 20 micron Nylon cloth filter, and the solids content of the dispersion was diluted to about 6 weight percent.

Subsequently, a 29 micron charge transport layer was coated on top of the above photogenerating layer from a solution prepared by dissolving N,N'-diphenyl-N,N-bis(3-methylphenyl)-1,1'-biphenyl-4,4'-diamine (mTBD, 4 grams), and a film forming polymer binder PCZ-400 [poly(4,4'-dihydroxy-diphenyl-1-1-cyclohexane, $M_w$=40,000)] available from Mitsubishi Gas Chemical Company, Ltd. (6 grams) in a solvent mixture of 21 grams of tetrahydrofuran (THF), and 9 grams of toluene, (70/30) followed by drying in an oven at about 120° C. for about 40 minutes. The resulting charge transport layer PCZ-400/mTBD ratio was 60/40.

Example III

A photoconductor was prepared by substantially repeating the process of Comparative Example 1 except that a 29 micron thick charge transport layer was coated on top of the photogenerating layer from a solution prepared from N,N'-diphenyl-N,N-bis(3-methylphenyl)-1,1-biphenyl-4,4'-diamine (4 grams), PCZ-400 [poly(4,4'-dihydroxy-diphenyl-1-1-cyclohexane, $M_w$=40,000)], available from Mitsubishi Gas Chemical Company, Ltd. (5 grams), and 1 gram of the charge transporting polycarbonate copolymer (CTPC) as prepared in Example I above. The ratio of PCZ400/CTPC/mTBD was 50/10/40.

Example IV

A photoconductor is prepared by substantially repeating the process of Comparative Example 1 except that a 29 micron thick charge transport layer is coated on top of the photogenerating layer from a solution prepared from N,N'-diphenyl-N,N-bis(3-methylphenyl)-1,1'-biphenyl-4,4'-diamine (4 grams), PCZ-400 [poly(4,4'-dihydroxy-diphenyl-1-1-cyclohexane, $M_w$=40,000)], available from Mitsubishi Gas Chemical Company, Ltd. (5 grams), and 1 gram of the charge transporting polycarbonate copolymer as prepared in Example II above. The ratio of PCZ400/CTPC/mTBD was 50/10/40.

Example V

Photoconductors are prepared by substantially repeating the process of Example III except that a 29 micron thick charge transport layer is coated on top of the photogenerating layer from a solution prepared with N,N'-diphenyl-N,N-bis(3-methylphenyl)-1,1'-biphenyl-4,4'-diamine (4 grams), the polycarbonate binder of poly(4,4'-isopropylidene-diphenylene) carbonate, poly(4,4'-cyclohexylidine diphenylene) carbonate, or poly(4,4'-isopropylidene-3,3'-dimethyl-diphenyl) carbonate (5 grams) and the CTPC (1 gram). The ratio of the polycarbonate/CTPC/mTBD is 50/10/40.

Electrical Property Testing

The above prepared photoconductors of Comparative Example 1 and Example III were tested in a scanner set to obtain photoinduced discharge cycles, sequenced at one charge-erase cycle followed by one charge-expose-erase cycle, wherein the light intensity was incrementally increased with cycling to produce a series of photoinduced discharge characteristic curves (PIDCs) from which the photosensitivity and surface potentials at various exposure intensities were measured. Additional electrical characteristics were obtained by a series of charge-erase cycles with incrementing surface potential to generate several voltages versus charge density curves. The scanner was equipped with a scorotron set to a constant voltage charging at various surface potentials. The above photoconductors were tested at surface potentials of 700 volts with the exposure light intensity incrementally increased by means of regulating a series of neutral density filters, and the exposure light source was a 780 nanometer light emitting diode. The xerographic simulation was completed in an environmentally controlled light tight chamber at ambient conditions (40 percent relative humidity and 22° C.).

The PIDCs obtained for the above two photoconductors evidenced a more rapid transport, about 35 percent increase, of charges or holes of the Example III photoconductor versus the Comparative Example 1 photoconductor as indicated by about 30 volts lower residual potential for the Example III photoconductor than for the Comparative Example 1 photoconductor.

Ghosting Measurements

Ghosting refers, for example, to when a photoconductor is selectively exposed to positive charges in a number of xerographic print engines, and where some of the positive charges enter the photoconductor and manifest themselves as a latent image in the subsequent printing cycles. This print defect can cause a change in the lightness of the half tones, and is commonly referred to as a "ghost" that is generated in the previous printing cycle. An example of a source of the positive charges is the stream of positive ions emitted from the transfer corotron. Since the paper sheets are situated between the transfer corotron and the photoconductor, the photoconductor is shielded from the positive ions from the paper sheets. In the areas between the paper sheets, the photoconductor is fully exposed, thus in this paper free zone the positive charges may enter the photoconductor. As a result, these charges cause a print defect or ghost in a half tone print if one switches to a larger paper format that covers the previous paper print free zone.

The Comparative Example 1 and the Example III photoconductors were acclimated at room temperature for 24 hours before testing in A zone (85° F. and 80 percent humidity) and in J zone (70° F. and 10 percent humidity) for ghosting. Print testing was accomplished in the Xerox Corporation WorkCentre™ Pro C3545 using the K (black toner) station at t of 500 print counts (t equal to 500 is the $500^{th}$ print), and the CMY stations of the color WorkCentre™ Pro C3545, which operated from t of 0 to t of 500 print counts.

The prints for determining ghosting characteristics includes an X symbol or letter on a half toned image. When X is invisible, the ghost level is assigned Grade 0; when X is barely visible, the ghost level is assigned Grade 1; Grade 2 to Grade 5 refers to the level of visibility of X with Grade 5 meaning a dark and visible X. Ghosting levels were visually measured against an empirical scale, the smaller the ghosting grade (absolute value), the better the print quality. A negative ghosting grade number, such as −2.5 in A zone, and −2 in J zone for Example III, translates into improved and excellent ghosting characteristics as compared to Comparative Example 1. The ghosting results are summarized in Table 1.

TABLE 1

| | UCL Composition | |
|---|---|---|
| | A Zone Ghosting T = 500 prints | J Zone Ghosting T = 500 prints |
| Comparative Example 1 | Grade −5 | Grade −4 |
| Example III | Grade −2.5 | Grade −2 |

Wear Testing

Wear tests of the photoconductors of Comparative Example 1 and Example III were performed using a wear test fixture (biased charging roll, BCR charging, and peak to peak voltage of 1.45 kilovolts). The total thickness of each photoconductor was measured by a Permascope before each wear test was initiated. Then the photoconductors were separately placed into the wear fixture for 50 kilocycles. The total photoconductor thickness was measured again with the Permascope, and the difference in thickness was used to calculate wear rate (nanometers/kilocycle) of the photoconductors. The smaller the wear rate value, the more wear resistant was the photoconductor.

TABLE 2

| | Wear Rate (Nanometers/Kilocycle) |
|---|---|
| Comparative Example 1 | 58.0 |
| Example III | 51.4 |

The 51.4 nanometers/kilocycle wear rate will extend the Example III photoconductor life by about 15 percent.

Long term, up to about 500,000 xerographic cycles in the Xerox Corporation WorkCentre™ Pro C3545, illustrated that the cyclic stability of the Example III photoconductor charge transport layer in both A zone and J zone were excellent and improved by about 25 percent versus the Comparative Example 1A zone and J zone charge transport layer photoconductor.

The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others. Unless specifically recited in a claim, steps or components of claims should not be implied or imported from the specification or any other claims as to any particular order, number, position, size, shape, angle, color, or material.

What is claimed is:

1. A photoconductor consisting of a supporting substrate, that includes on the back of said substrate an anticurl layer; a photogenerating layer in contact with said supporting substrate ad which substrate is situated between said anticurl layer and said photogenerating layer, and a charge transport layer consisting of a charge transport component, a charge transporting polycarbonate polymer selected from one of the following formulas/structures
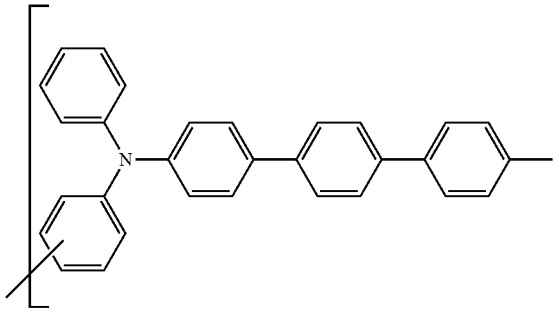
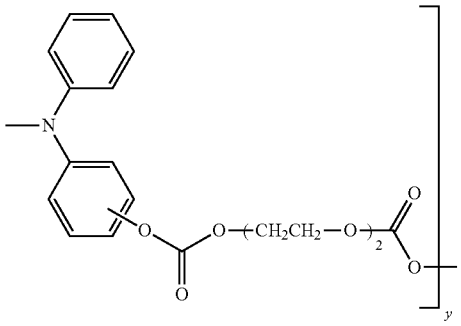
;
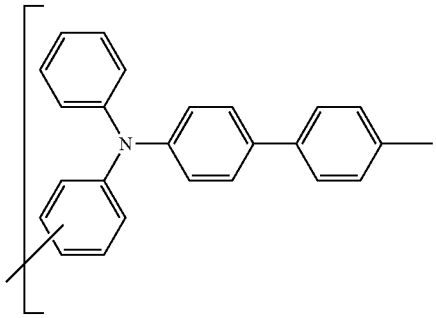
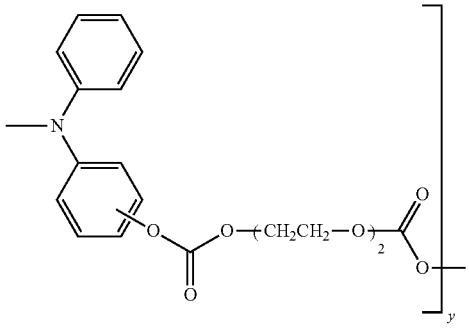
;
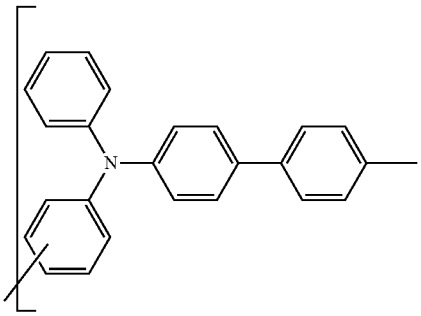
-continued
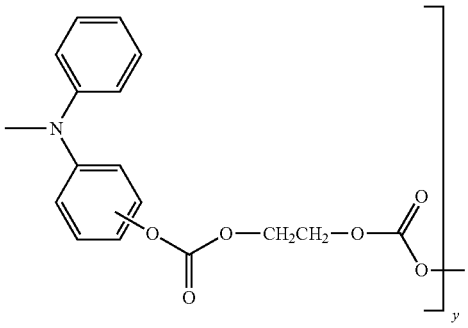
;
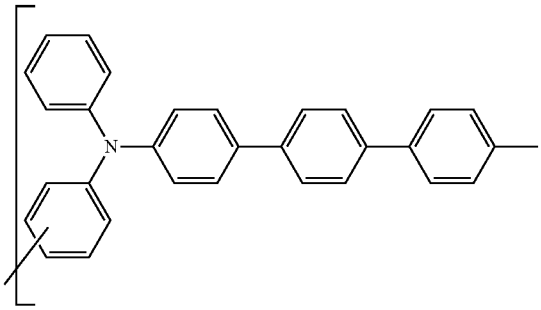
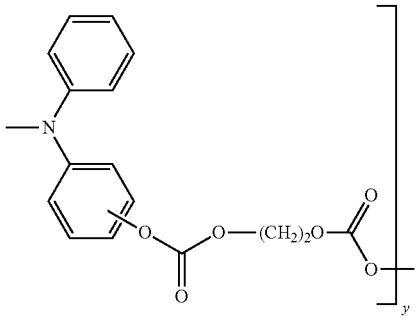
;
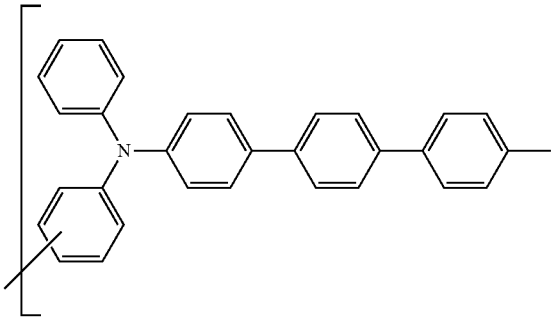
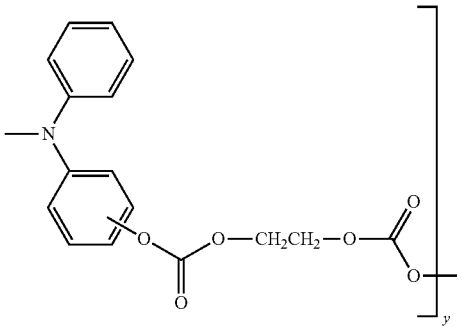
;

-continued

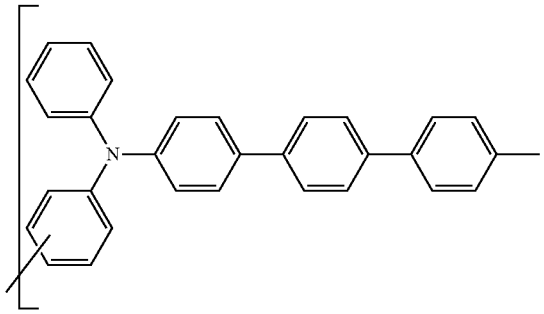

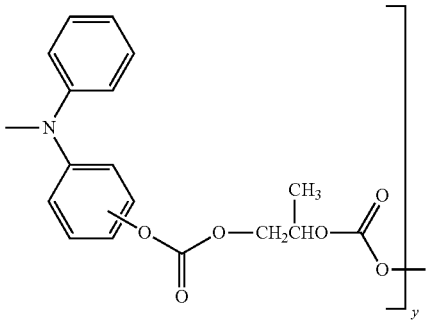

;

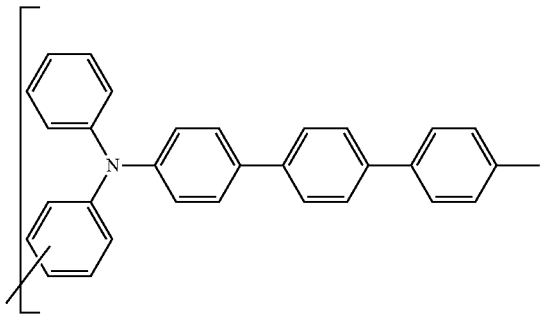

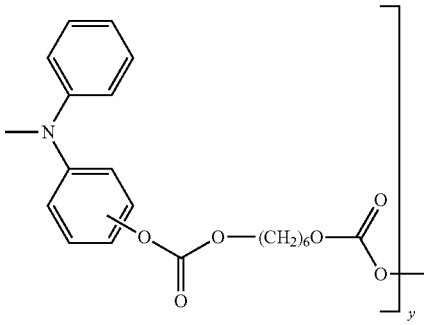

and

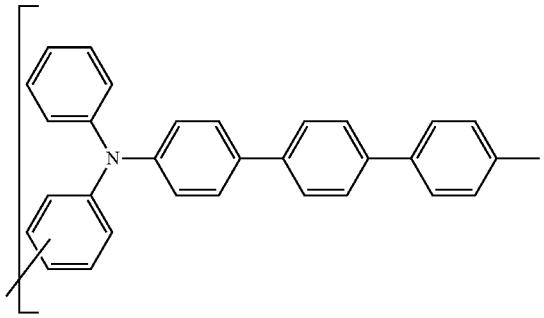

-continued

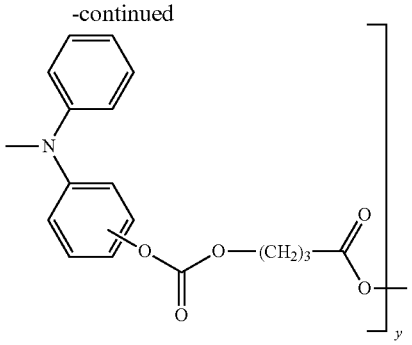

wherein y represents the number of repeating segments in the charge transporting polycarbonate, and is a number of from about 10 to about 5,000 and a polycarbonate different from said charge transporting polycarbonate polymer.

2. A photoconductor in accordance with claim 1 wherein said charge transporting polycarbonate polymer has a weight average molecular weight of from about 25,000 to about 400,000, and a number average molecular weight of from about 20,000 to about 200,000.

3. A photoconductor in accordance with claim 1 wherein said photoconductor possesses minimal ghosting characteristics with a ghosting value of from about a −2 grade to about a −3 grade.

4. A photoconductor in accordance with claim 1 wherein said photoconductor possesses a wear rate of from about 45 to about 55 nanometers per xerographic kilocycle.

5. A photoconductor in accordance with claim 1 wherein y is a number of from about 50 to about 4,000.

6. A photoconductor in accordance with claim 1 wherein y is a number of from about 100 to about 3,500, and said charge transporting polycarbonate polymer is present in an amount of from about 10 to about 30 weight percent.

7. A photoconductor in accordance with claim 1 wherein y is a number of from about 500 to about 2,000.

8. A photoconductor in accordance with claim 1 wherein said different polycarbonate is selected from the group consisting of poly(4,4'-dihydroxy-diphenyl-1-1-cyclohexane), poly(4,4'-isopropylidene-diphenylene)carbonate, poly(4,4'-cyclohexylidine diphenylene) carbonate, and poly(4,4'-isopropylidene-3,3'-dimethyl-diphenyl) carbonate and wherein said different polycarbonate is present in an amount of from about 70 to about 95 weight percent.

9. A photoconductor in accordance with claim 1 wherein said charge transport layer consists of a first charge transport layer in contact with said photogenerating layer, and a second charge transport layer in contact with said first charge transport layer, and wherein said charge transporting polycarbonate polymer and said different polycarbonate are present in said second charge transport layer.

10. A photoconductor in accordance with claim 1 wherein said charge transport component is selected from the group consisting of those represented by the following formulas/structures

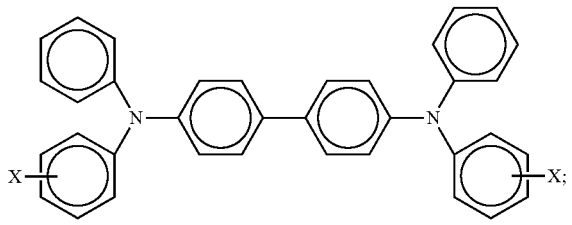

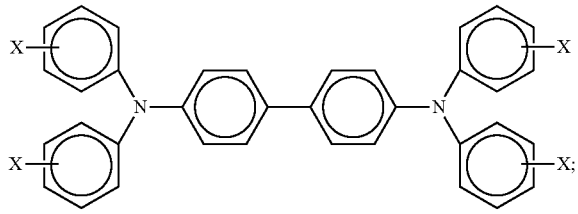

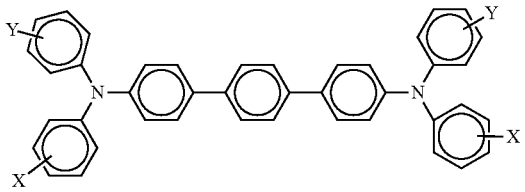

and

-continued

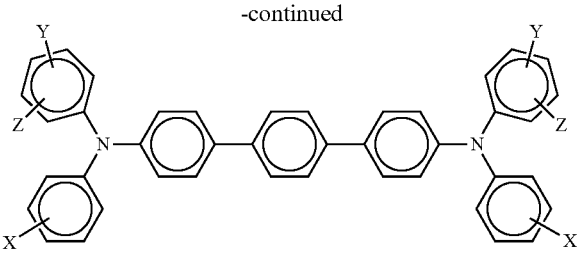

wherein X, Y, and Z are independently selected from the group consisting of alkyl, alkoxy, aryl, halogen, and mixtures thereof.

11. A photoconductor in accordance with claim 1 wherein said charge transport component is selected from the group consisting of N,N'-bis(methylphenyl)-1,1-biphenyl-4,4'-diamine, tetra-p-tolyl-biphenyl-4,4'-diamine, N,N'-diphenyl-N,N'-bis(4-methoxyphenyl)-1,1-biphenyl-4,4'-diamine, N,N'-bis(4-butylphenyl)-N,N'-di-p-tolyl-[p-terphenyl]-4,4'-diamine, N,N'-bis(4-butylphenyl)-N,N'-di-m-tolyl-[p-terphenyl]-4,4'-diamine, N,N'-bis(4-butylphenyl)-N,N'-di-o-tolyl-[p-terphenyl]-4,4'-diamine, N,N'-bis(4-butylphenyl)-N,N'-bis-(4-isopropylphenyl)-[p-terphenyl]-4,4'-diamine, N,N'-bis(4-butylphenyl)-N,N'-bis-(2-ethyl-6-methylphenyl)-[p-terphenyl]-4,4'-diamine, N,N'-bis(4-butylphenyl)-N,N'-bis-(2,5-dimethylphenyl)-[p-terphenyl]-4,4'-diamine, and N,N'-diphenyl-N,N'-bis(3-chlorophenyl)-[p-terphenyl]-4,4'-diamine.

12. A photoconductor in accordance with claim 1 wherein said photogenerating layer includes a photogenerating pigment selected from the group consisting of a titanyl phthalocyanine, a hydroxygallium phthalocyanine, a halogallium phthalocyanine, a chlorogallium phthalocyanine, and mixtures thereof.

13. A photoconductor in accordance with claim 1 wherein said charge transporting polycarbonate polymer is

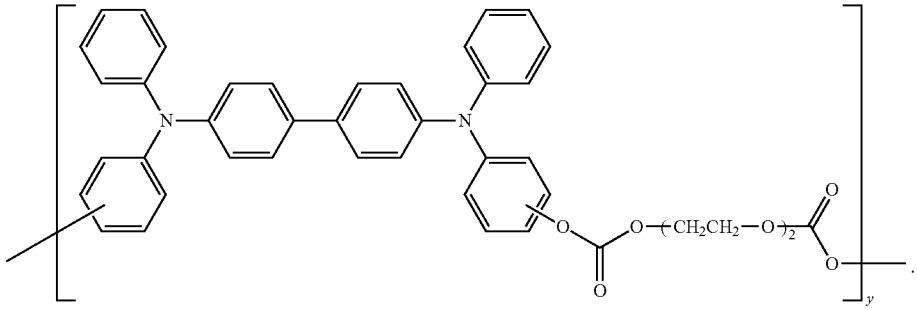

14. A photoconductor in accordance with claim 13 wherein y is from about 500 to about 2,000.

15. A photoconductor in accordance with claim 13 wherein y is about 450.

16. A photocunductor in accordance with claim 1 wherein said charge transporting polycarbonate polymer is

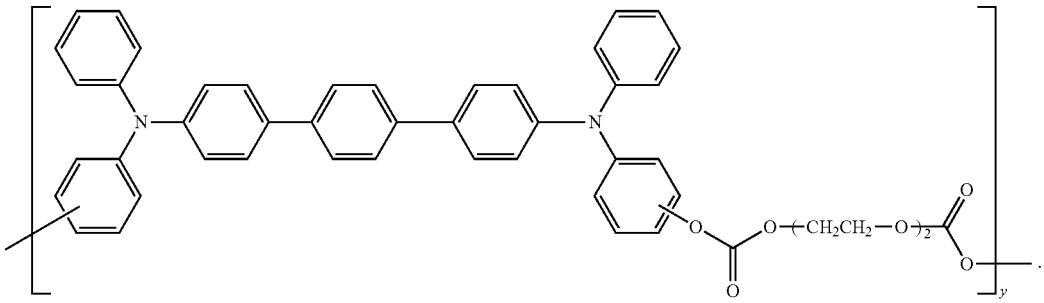

17. A photoconductor in accordance with claim 16 wherein y from about 500 to about 2,000.

18. A photoconductor in accordance with claim 16 wherein y is about 450.

19. A photoconductor consisting of a supporting substrate layer, a hole blocking layer, an adhesive layer, a photogenerating layer containing photogenerating pigments dispersed therein, a first charge transport layer containing a charge transport compound, and a mixture of a polycarbonate and a charge transporting polycarbonate, and a second charge transport layer containing a charge transport compound, and a mixture of a polycarbonate and a charge transporting polycarbonate, and wherein the ghosting characteristics of said photoconductor are from about a grade of −1 to a grade of about a −2.5, and the photoconductor wear rate is from about 45 nanometers per kilocycle to about 55 nanometers per kilocycle and wherein said charge transporting polycarbonate is selected from one of the following formulas/structures

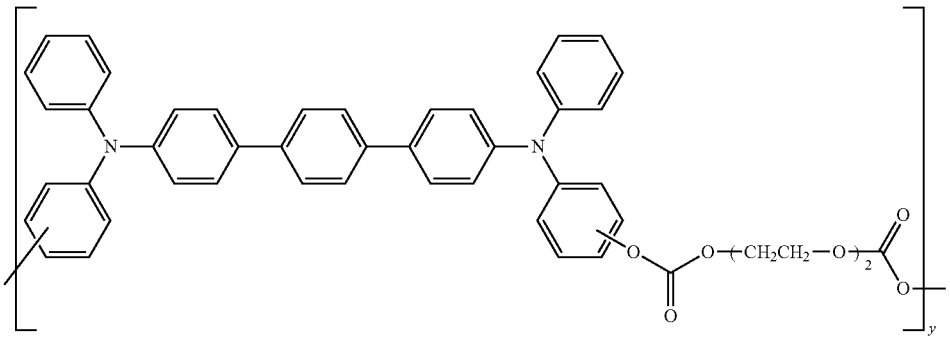

;

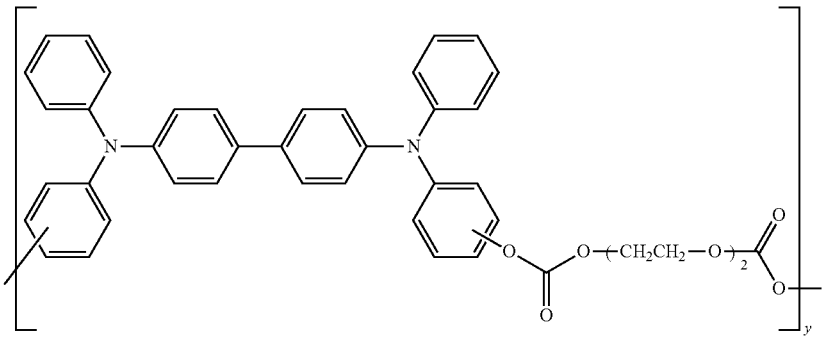

;

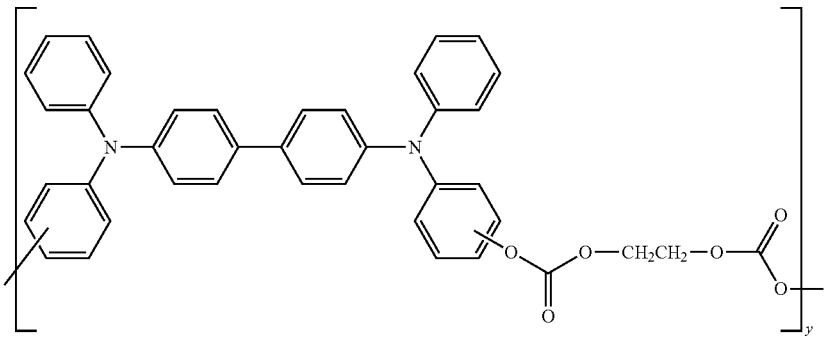

;

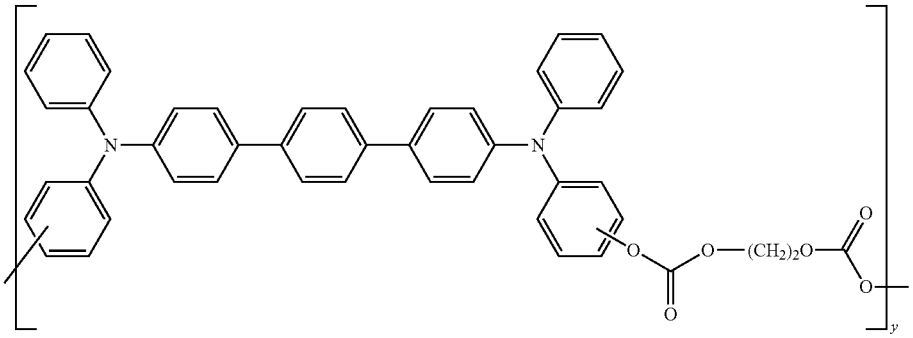

;

-continued

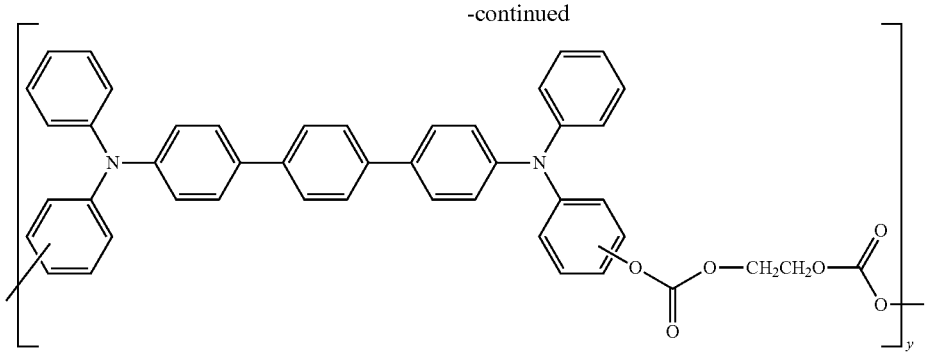

;

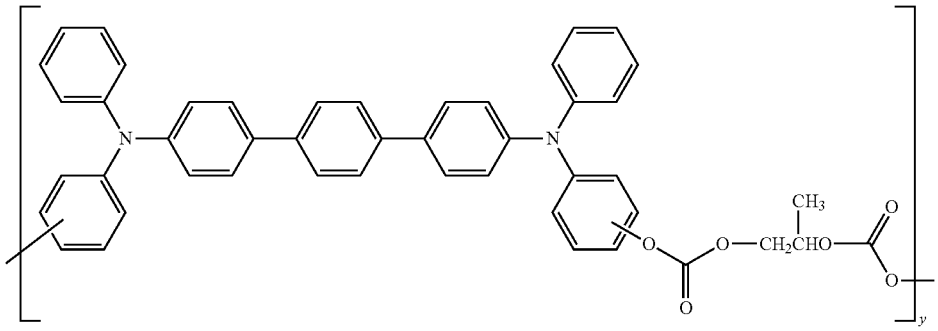

;

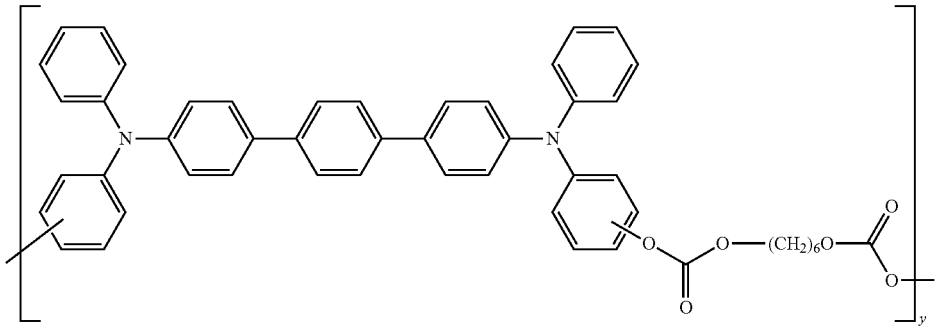

and

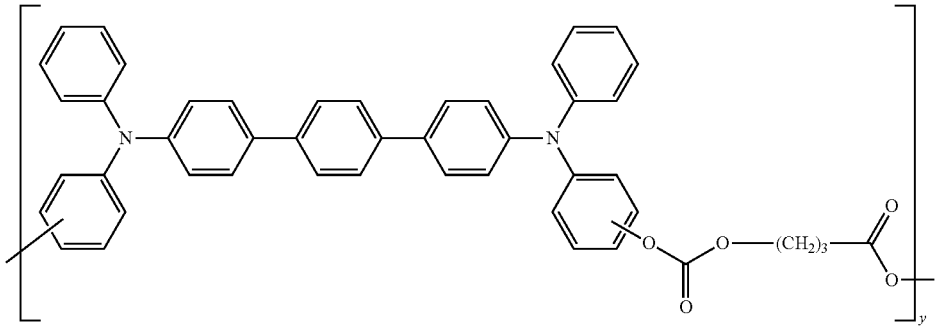

wherein y represents the number of repeating segments in the charge transporting polycarbonate, and is a number of from about 50 to about 4,000.

20. A photoconductor comprising a supporting substrate, that includes on the back of said substrate an anticurl layer, a photogenerating layer, and a charge transport layer comprising a charge transport component, a charge transporting polycarbonate polymer selected from one of the following formulas/structures and a polycarbonate, and wherein the ghosting characteristics of said photoconductor are from about a rake of −1 to a grade of about a −3, and the photoconductor wear rate is from about 45 nanometers per kilocycle to about 55 nanometers per kilocycle

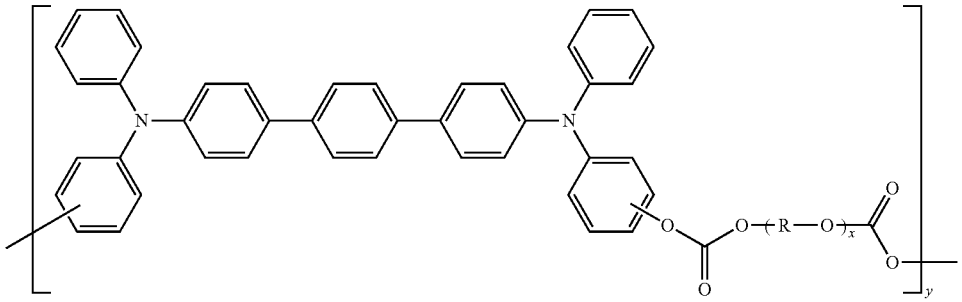
and
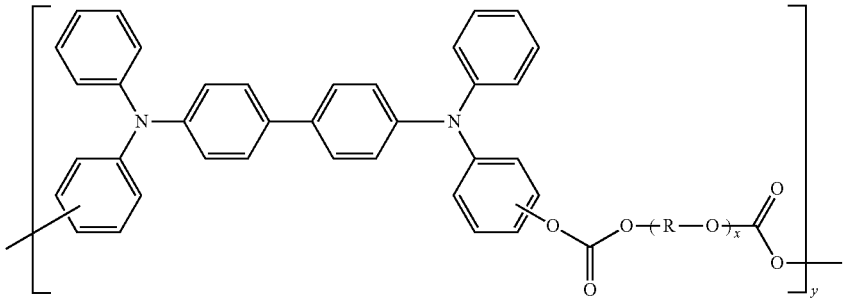
wherein R is alkylene, x is from about 1 to about 20, and y is a number of from about 200 to about 3,000.
* * * * *